US007874377B1

(12) United States Patent
Graeve

(10) Patent No.: US 7,874,377 B1
(45) Date of Patent: Jan. 25, 2011

(54) CIRCLE DRIVE ARRANGEMENT FOR MOTOR GRADER

(75) Inventor: Joshua Dean Graeve, Peosta, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 12/608,116

(22) Filed: Oct. 29, 2009

(51) Int. Cl.
*E02F 3/00* (2006.01)

(52) U.S. Cl. ..... 172/796

(58) Field of Classification Search ..... 172/781, 172/792, 796
See application file for complete search history.

(56) References Cited

U.S. PATENT DOCUMENTS 2,159,245 A * 5/1939 Benedek ..... 91/494
2,195,306 A * 3/1940 Henry et al. ..... 172/796
2,323,108 A * 6/1943 Arndt ..... 172/796
2,404,127 A * 7/1946 Ernst ..... 89/41.12
3,675,724 A * 7/1972 Schneider ..... 172/116
3,762,481 A * 10/1973 Allen et al. ..... 172/40
6,176,085 B1 * 1/2001 Kirakos-Shirvanyan ..... 60/444
6,537,047 B2 * 3/2003 Walker ..... 418/147
7,575,068 B2 * 8/2009 Stubben et al. ..... 172/781

* cited by examiner

*Primary Examiner*—Thomas B Will
*Assistant Examiner*—Joel F Mitchell

(57) ABSTRACT

A motor grader is equipped with a circle drive arrangement including a variable displacement motor capable of operating at a high speed for driving the circle at a high speed, as when the blade is elevated above the ground and the grader is turning around for reversing the operation of the blade, and capable of operating at a high torque for driving the circle to change the angle of operation of the blade relative to the grader frame when the blade is in ground contact.

2 Claims, 4 Drawing Sheets

CIRCLE DRIVE ARRANGEMENT FOR MOTOR GRADER

FIELD OF THE INVENTION

The present invention relates to motor graders, and more particularly, relates to a circle drive arrangement for a motor grader.

BACKGROUND OF THE INVENTION

It is common practice to provide a motor grader with one or more hydraulic motors which are connected for driving an internal annular gear forming part of a circle structure to which the grader blade is attached and rotated to change its angularity relative to the direction of travel of the motor grader. Heretofore, the hydraulic motors provided for performing this rotate function have been fixed displacement motors. However, it is desirable to be able to rotate the blade at a high speed when placing it in a mirror image position when the grader is being turned to reverse its direction of operation. Also desirable is the ability to apply a high torque for turning the blade when the blade is in ground contact. High speed and high torque functionality are not usually required at the same time.

The provision of a fixed displacement motor which can both operate to drive the circle at a satisfactory high speed and to impart a satisfactory torque to the blade creates some tradeoffs in the circle drive design. For example, the need for high torque and high speed makes the total hydraulic horsepower required for this function much higher than the other functions on the motor grader. Tradeoffs for keeping the total hydraulic system in balance may include reducing hydraulic flow for effecting rotation of the circle, thus requiring a smaller control valve. The overall pump size could also be reduced if the flow for effecting rotation of the circle was reduced, or the pump size could remain the same with an overall improvement in flow availability.

It is desired then to be able to drive the circle of a motor grader at a high speed or at a high torque without necessitating an increase in the size of the pump or control valves used for the circle drive function.

SUMMARY OF THE INVENTION

According to the present invention, there is provided an improved motor grader circle drive, and more specifically there is provided a circle drive which overcomes the above-noted operational deficiencies of the prior art without requiring any substantial increase in manufacturing cost for the circle drive.

An object of the invention is to provide a circle drive arrangement for producing a high torque at a low speed when the motor grader blade is in ground contact and for producing a high speed under low torque when the grader blade is out of ground contact.

The foregoing object is achieved by providing a circle drive arrangement incorporating a variable displacement hydraulic motor that operates such that an increase in displacement causes a decrease in speed while increasing the torque output, and vice-versa.

In one embodiment, the displacement of the motor is defaulted to its minimum displacement, with the work port pressure of the motor being used to control the displacement, the work port pressure increasing as a direct function of forces resisting blade rotation.

In another embodiment, the motor displacement is normally set at a maximum displacement for effecting high torque operation and an operator may actuate a selector valve operable for routing control fluid pressure for causing movement of the displacement device of the motor to be shifted to a minimum displacement for causing a high speed operation of the motor.

DESCRIPTION OF THE PREFERRED EMBODIMENT

Figure 1:
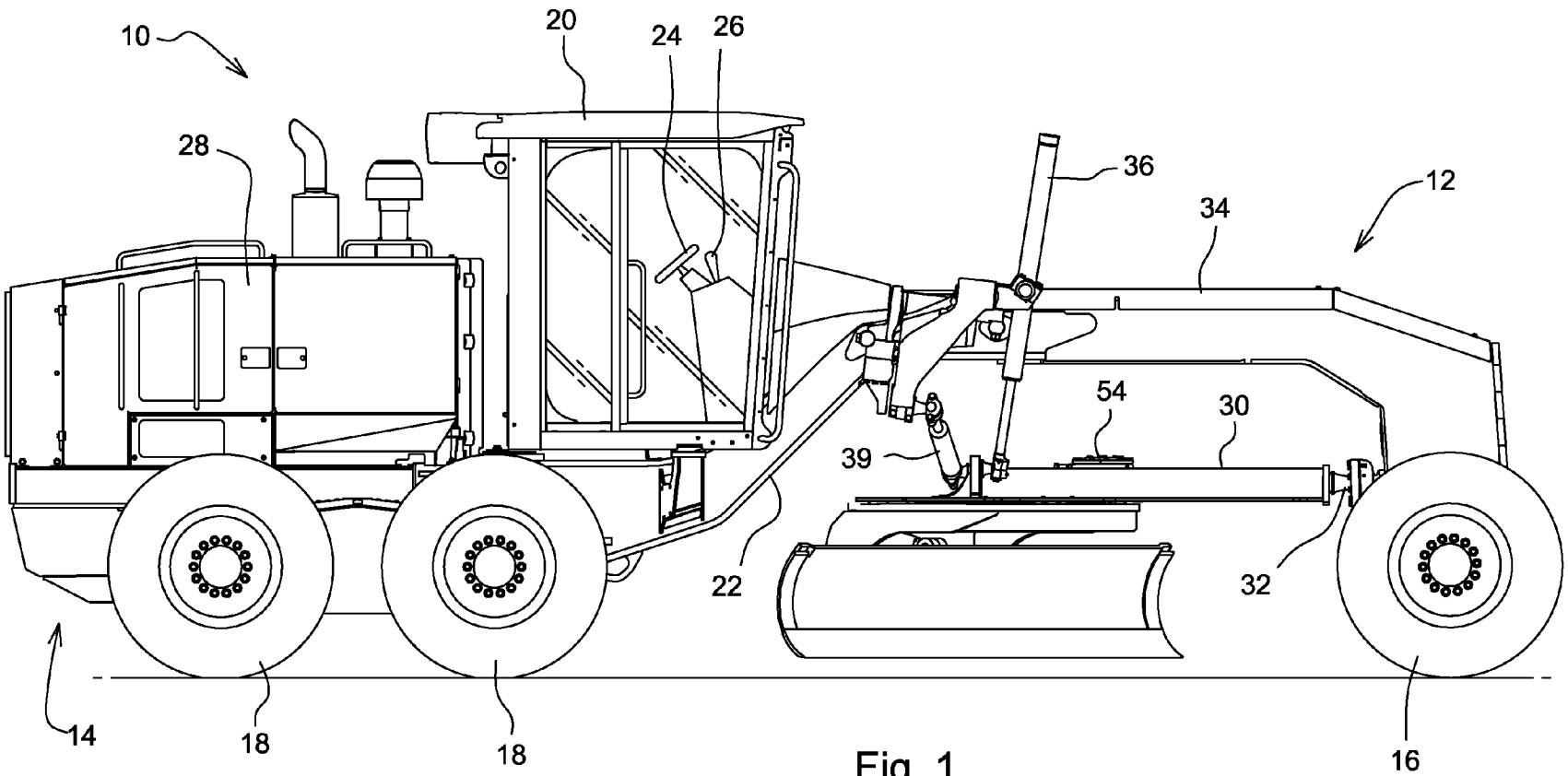
FIG. 1 is a right side view of a motor grader traveling toward the right with the blade angled for moving engaged material to the right.
Figure 2:
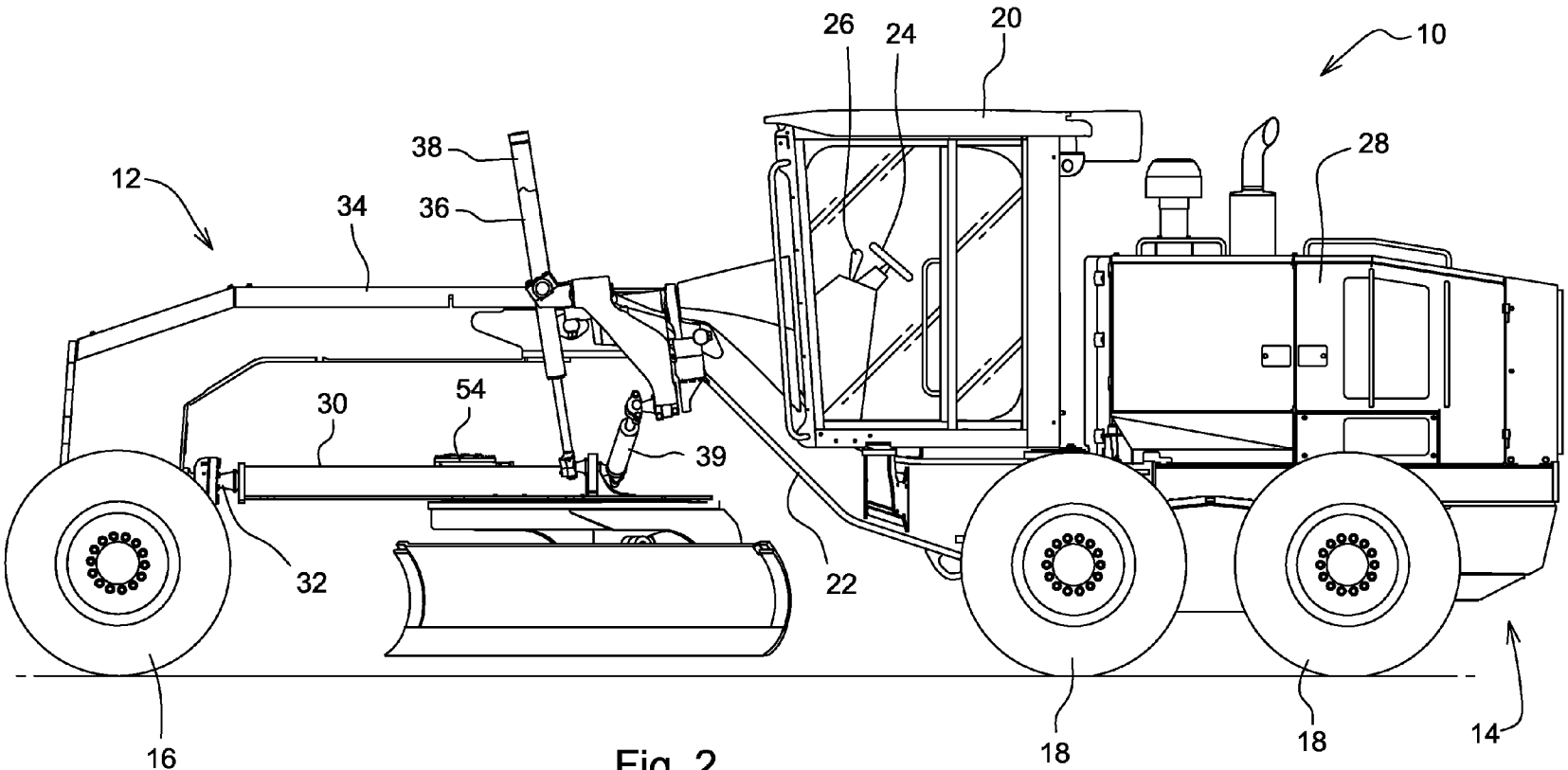
FIG. 2 is a left side view of a motor grader traveling toward the left with the blade angled for moving engaged material to the left.

Referring now to FIGS. 1 and 2, there is shown a motor grader 10 including front and rear frames 12 and 14, respectively, with the front frame being supported on a pair of front wheels 16, and with the rear frame being supported on right and left tandem sets of rear wheels 18. An operator cab 20 is mounted on an upwardly and forwardly inclined rear region 22 of the front frame 12 and contains various controls for the motor grader disposed so as to be within the reach of a seated or standing operator, these controls including a steering wheel 24 and a lever assembly 26. An engine 28 is mounted on the rear frame 14 and supplies the driving power for all driven components of the motor grader. For example, the engine 28 is coupled for driving a transmission (not shown) coupled for driving the rear wheels 18 at various selected speeds and either in forward or reverse modes. A hydrostatic front wheel assist transmission (not shown) may be selectively engaged to power the front wheels 16, in a manner well known in the art.

Mounted to a front location of the front frame 12 is a drawbar 30, having a forward end universally connected to the front frame by a ball and socket arrangement 32 and having opposite right and left rear regions suspended from an elevated central section 34 of the main frame 12 by right and left lift linkage arrangements including right and left extensible and retractable hydraulic actuators 36 and 38, respectively. A side shift linkage arrangement is coupled between the elevated frame section 34 and a rear location of the drawbar 30 and includes an extensible and retractable side swing hydraulic actuator 39.

Figure 3:
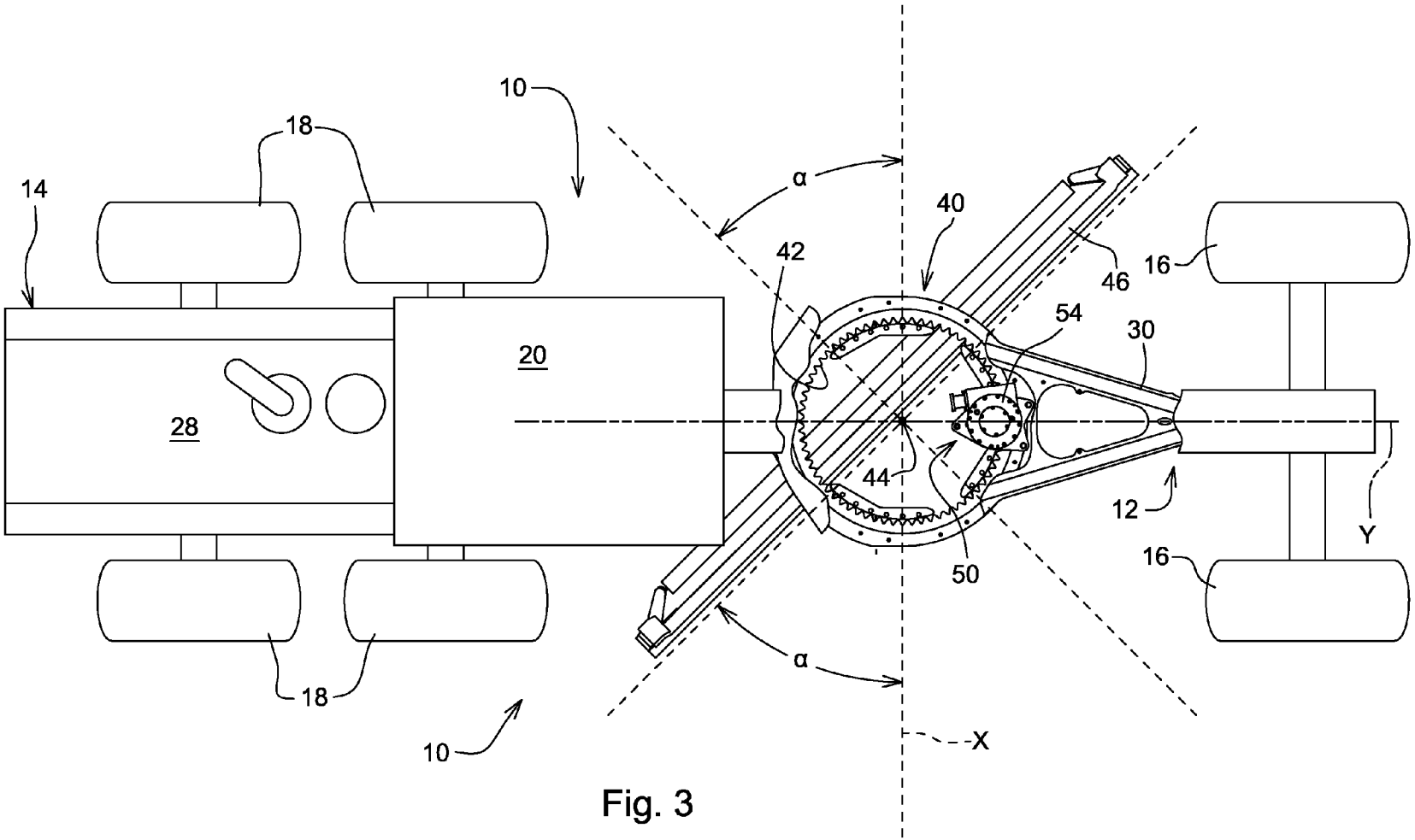
FIG. 3 is a schematic top view of the motor grader with parts broken way showing the drawbar and circle frame with the blade being shown in mirror image positions respectively corresponding the those shown in FIGS. 1 and 2.

Referring now also to FIG. 3, it can be seen that a circle 40, which defines a large internal annular gear, indicated by broken lines 42, is mounted to a rear region of the drawbar 30 for rotation about an upright central axis 44 of the annular gear in a manner well known in the art. An elongate blade 46 extends parallel to, and beneath a planar lower surface of the annular gear 42 of the circle 40 and is fixed to the circle so that, when the circle rotates about the axis 44, an angle $\alpha$ the blade 46 makes relative to a line X extending perpendicular to a direction of travel Y is adjusted. The blade 46 is illustrated in a position corresponding to that illustrated in FIG. 1 wherein earth engaged by the blade will slide rightward along a front face of the blade and will be deposited outside the track of the right set of tandem rear wheels 18. When the motor grader 10 is operating in the opposite direction, corresponding to that shown in FIG. 2, the blade 46 is rotated 90° clockwise into a position 46' which is a mirror image of that shown in FIGS. 1 and 3 so that the blade 48 may traverse the same path and move earth in the same direction.

Provided for selectively adjusting the circle 40 angularly about the axis 44 is a circle drive 50 mounted to the drawbar 30 and including a gear 52 having teeth (not shown) meshed with the teeth (also not shown) of the annular internal gear 42. A variable displacement circle drive motor 54 has an output shaft coupled directly to the gear 52 of the circle drive, although this need not be since the motor 54 may be connected to the internal gear 42 by way of a train of meshed gears, if desired.

Figure 4:
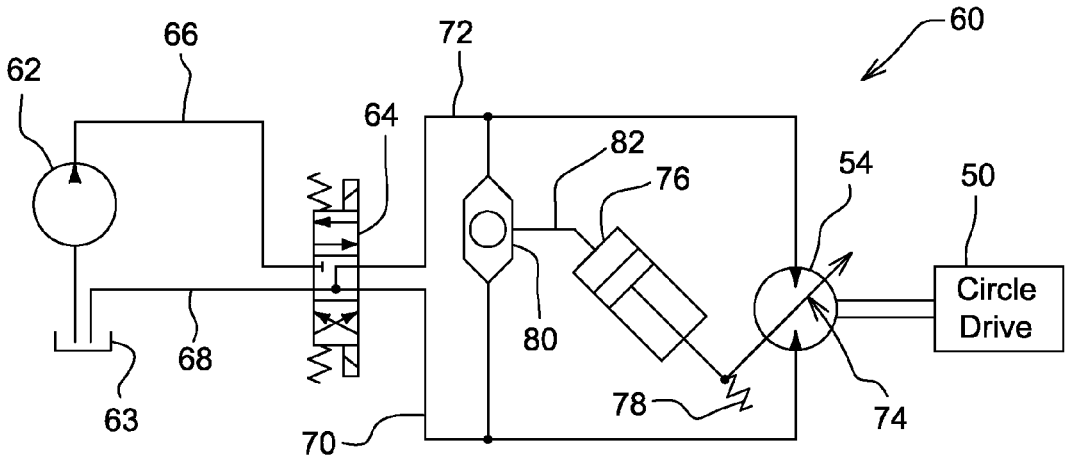
FIG. 4 is a schematic electro-hydraulic circuit showing an arrangement for controlling the displacement of a variable displacement circle drive motor as a function of the work port pressure.

Referring now to FIG. 4, there is shown an electro-hydraulic control arrangement 60 for the variable displacement hydraulic motor 54. The control arrangement 60 includes a pump 62, a sump 63, a solenoid-operated direction control valve 64. The pump 62 has an inlet coupled to the sump 63 and an outlet coupled to the direction control valve 64 by a pressure supply line 66, with the valve 64 also being coupled to the sump 63 by a return line 68. The direction control valve 64 is connected to one work port of the motor 54 by a forward drive pressure line 70 and to another work port of the motor 54 by a reverse drive pressure line 72. The motor 54 includes a displacement control device 74 having a pressure-shiftable device 76 coupled to the displacement control device 74 and disposed in opposition to a spring 76 coupled for biasing the displacement control device 74 to its minimum displacement position. Provided for conveying working pressure to the pressure-shiftable device 76 is a shuttle valve 80 coupled between the lines 70 and 72 and having an outlet coupled to the device 76 by a line 82. Thus, the shuttle valve 80 operates to direct the higher of the pressures found in the lines 70 and 72 to the device 76 whereby the displacement established by the control device 74 is a function of the working pressure of the motor 54.

Figure 5:
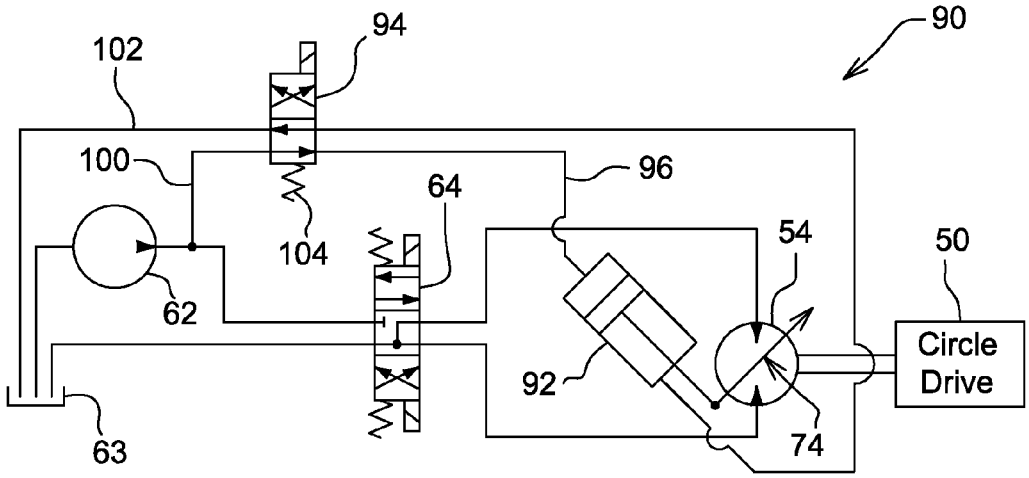
FIG. 5 is a schematic electro-hydraulic circuit showing an arrangement for manually selecting between a normal maximum displacement and a minimum displacement of a variable displacement circle drive motor.

Referring now to FIG. 5, an alternate electro-hydraulic control arrangement 90 is shown for controlling the displacement of the variable displacement motor 54. The control arrangement 90 differs from the previously described control arrangement 60 in that instead of the displacement of the motor 54 being controlled between maximum and minimum settings as a function of motor work port pressure, the motor displacement is instead controlled so that the motor 54 operates at two settings respectively being minimum and maximum displacement settings. This is achieved by coupling a double-acting hydraulic cylinder 92 to the motor displacement control device 74, with opposite ports of the cylinder 92 being selectively coupled to the pump 62 or to the sump 63 by a solenoid operated selector valve 94 coupled to the opposite cylinder ports by pressure/return lines 96 and 98, and to the pump 62 and sump 63 by pressure and return lines 100 and 102, respectively. The selector valve 94 is normally biased to a maximum displacement effecting position by a spring 104 with pressure then being coupled to the top of the cylinder 92 and the bottom of the cylinder being coupled to the sump 63. This maximum displacement condition of the motor 54 is that available for generating maximum torque during normal operation of the motor grader 10 with the blade 46 placed in ground engagement. In order to be able to quickly rotate the blade 46, for example to place the blade in a mirror image position with the blade 46 being elevated above the ground while turning the motor grader 10 to operate in the opposite direction, the operator may energize the solenoid of the selector valve 94 so that it shifts against the bias of the spring 104 to an alternate position wherein the bottom port of the cylinder 92 is coupled to the pump 62 with the top of the cylinder then being coupled to the sump 63. The displacement control device 74 is then moved into it minimum displacement effecting position so that a high motor speed is achievable for quickly rotating the blade 46.

While not shown here, it will be appreciated that a further embodiment of a displacement control device could be provided utilizing an electrically responsive, reversible linear motor coupled to the displacement control device 74, with an operator having a manual control for varying the strength of an electrical control signal sent to the linear motor so as to effect a desired motor displacement.

The operation of the variable displacement motor 54 for effecting high displacement, high torque operation when needed for rotating the blade 46 when the latter is in ground engagement, and for effecting low displacement, high speed operation of the motor 54 when the blade is elevated for speedily adjusting the blade angle, as for example, when the motor grader 10 is being turned for operation along a given path in a direction opposite to that just completed, is thought to be evident from the above description and is not repeated for the sake of brevity.

Having described the preferred embodiment, it will become apparent that various modifications can be made without departing from the scope of the invention as defined in the accompanying claims.

The invention claimed is:

1. In a motor grader including a drawbar, a circle defining an annular gear and being mounted to said drawbar for rotation about an upright axis, a blade fixed for moving with said circle, a circle drive arrangement including said annular gear, a hydraulic motor having an output shaft and a gear arrangement being coupled between said output shaft and said annular gear for driving said circle to thereby adjust said blade angularly about said axis, the improvement comprising: said hydraulic motor being a variable displacement motor including a displacement adjuster movable between maximum and minimum displacement positions; a pressure responsive control device being coupled to said displacement adjuster for selectively moving said displacement adjuster between said maximum and minimum displacement positions; a selector valve being coupled to said pressure responsive control device and to a source of fluid pressure and a sump and selectively movable between a normal first position connecting said source of fluid pressure to said control device so as to effect said maximum displacement position of said displacement adjuster and a second position connecting said source of fluid pressure to said control device so as to effect said minimum displacement position of said displacement adjuster.

2. In a motor grader including a drawbar, a circle defining an annular gear and being mounted to said drawbar for rotation about an upright axis, a blade fixed for moving with said circle, a circle drive arrangement including said annular gear, a hydraulic motor having an output shaft and a gear arrangement being coupled between said output shaft and said annular gear for driving said circle to thereby adjust said blade angularly about said axis, the improvement comprising: said hydraulic motor being a variable displacement motor including a displacement adjuster movable between maximum and minimum displacement positions; and a biasing arrangement being provided for resisting movement of said displacement adjuster from said minimum displacement position; and a pressure responsive device coupled to said displacement adjuster for increasing the displacement of said motor directly in response to increasing pilot pressure; and said pressure responsive device being coupled for receiving a pilot pressure from a work port of said motor, whereby an increase in resistance to movement of said blade by said motor will cause an increase in work port pressure, resulting in an increase in motor displacement.

* * * * *